United States Patent [19]

Riedl

[11] 3,997,278

[45] Dec. 14, 1976

[54] VIBRATION TAMPER DEVICE

[75] Inventor: Franz Riedl, Munich, Germany

[73] Assignee: Wacker-Werke KG, Munich, Germany

[22] Filed: Mar. 2, 1976

[21] Appl. No.: 663,094

[30] Foreign Application Priority Data

Mar. 7, 1975 Germany ..... 2510063

[52] U.S. Cl. ..... 404/133; 404/113

[51] Int. Cl.[2] ..... E01C 19/34

[58] Field of Search ..... 404/133, 101, 113, 102, 404/117, 118, 122, 120

[56] References Cited

UNITED STATES PATENTS

| | | | |
|---|---|---|---|
| 1,495,901 | 5/1924 | French | 404/133 |
| 2,633,782 | 4/1953 | Clement | 404/133 |
| 2,701,939 | 2/1955 | Gardner | 404/133 |
| 2,746,367 | 5/1956 | Ferguson | 404/133 |
| 3,515,043 | 6/1970 | Austin | 404/103 |
| 3,923,412 | 12/1975 | Linz | 404/133 |
| R20,663 | 3/1938 | Cameron | 404/113 |

*Primary Examiner*—Nile C. Byers
*Attorney, Agent, or Firm*—Walter Becker

[57] ABSTRACT

A vibration tamper device in which a frame having spaced wheels on a horizontal shaft on which a rocker is tiltable in a fore and aft plane and has tamper feet at the opposite ends. An engine supported on the shaft drives a reciprocatory member which is connected to the rocker to oscillate the rocker and cause the tamper feet to engage the ground alternately. A one way clutch is preferably interposed between the rocker and at least one wheel so the device will move as the rocker oscillates.

7 Claims, 2 Drawing Figures

VIBRATION TAMPER DEVICE

Figure 1:
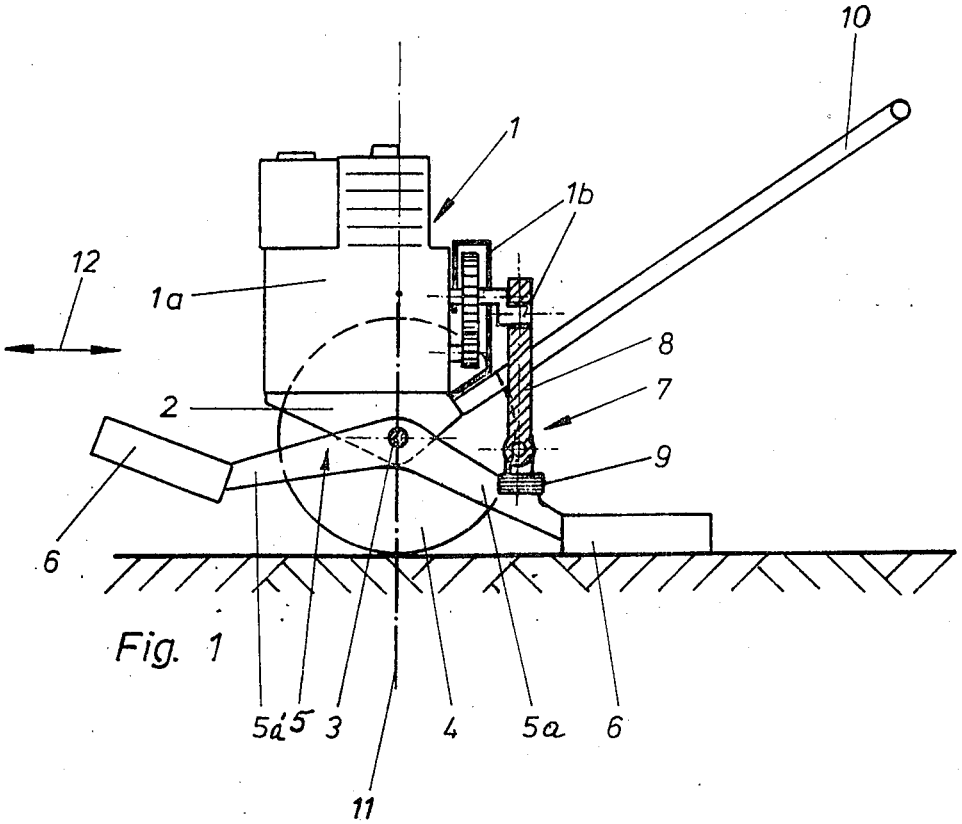

The present invention relates to a vibration tamper in which the upper mass including the motor and an eccentric drive is connected to a supporting frame which is movable on the ground in the advancing direction on skids, wheels or the like, and in which said supporting frame is pivotable about a frame axle relative to the ground which frame axle is perpendicular to the ground. More specifically, the present invention relates to a vibration tamper of the just mentioned type in which the crankdrive drives the impacting device through a driving connection with an energy storing element, said impacting device being reciprocable by said crankdrive relative to the upper mass in the direction about perpendicular to the ground.

With heretofore known vibration tampers of the general type referred to above, the arrangement is such that the tamping device comprising a single tamping foot exerts reaction forces upon the upper mass at a spot which is spaced by a considerable distance from the center of gravity line of said upper mass. Furthermore, the driving mechanism is not connected to the tamping device at a point which is substantially neutral with regard to rotational oscillations. This results in a rather disquiet, irregular operation of the device, and especially brings about undue relative movements of the carriage frame relative to the ground. As a rule, also the frame axle is arranged at a greater distance from the center of gravity line of the upper mass so that also the guiding of the device with the U-shaped handle customarily connected to the upper mass causes considerable efforts.

There have furthermore become known vibration tampers of a heavy design in which the energy storage element at the same time also serves for supporting the upper mass on the tamping foot and thereby on the ground. Tamping devices of this type over tamping devices referred to above have the drawback that the upper mass and the energy storage element have to be adapted to each other in order to assure that on one hand the upper mass will during the operation of the tamping device remain as quiet as possible, whereas on the other hand a maximum of impact energy is conveyed to the ground. This places rather narrow designing limits on the designer and on the possibility of increasing the output with the same weight of the upper masses. Moreover, these known devices have the additional drawback that highly compact ground likewise causes disorders in the adaptation between the upper mass and the tamping foot so that these devices will not work satisfactorily on such ground. Finally, these known tamping devices also have the drawback that they can be moved from one working station to another working station only by means of an additional driving device which each time have to be connected thereto and disconnected therefrom.

A further heretofore known design of vibration tampers differs from the above mentioned second type of vibration tampers in that the eccentric drive in opposite phases drives two tamping feet which are each connected to the eccentric drive by means of an energy storage element of its own which at the same time serves for supporting the upper mass against the tamping foot. These known devices have the same general drawback as those discussed above and have the additional drawback that due to the employment of two separate energy storage elements have a lower degree of efficiency than the previously discussed known devices of the type involved.

It is, therefore, an object of the present invention to provide a tamping device in which the above mentioned drawbacks of the heretofore devices will be avoided. In other words, it is an object of the present invention to provide a tamping device which can also move in operation on wheels, skids, or the like, and still operates relatively quietly while a critical adaptation between upper mass and energy storage element is not important, and which does not encounter any difficulties when the ground is sticky, and which also has a good degree of efficiency and can be guided and moved in operation without the employment of great forces.

These objects and other objects and advantages of the invention will appear more clearly from the following specification in connection with the accompanying drawings, in which:

FIG. 1 is a side view of the vibration tamper according to the invention.

Figure 2:
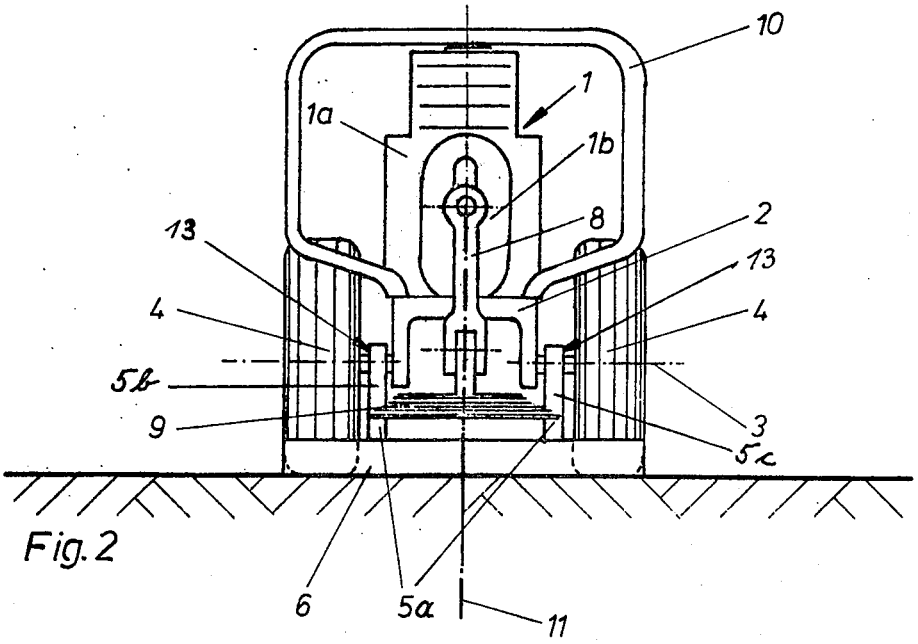

FIG. 2 is a rear view of the vibration tamper shown in FIG. 1. The vibration tamper according to the present invention is characterized primarily in that the tamping device comprises a rocker having at each end thereof respectively provided a tamping foot, which rocker is pivotable about the frame axle in a plane which is parallel to the advancing direction and about perpendicular to the ground, and which is engaged by the driving connection in spaced relationship to the axle of the frame.

Over the above mentioned vibration tampers, the tamping device according to the invention has the advantage that the resultant of the reaction forces exerted by the tamping device upon the upper mass coincides with the axis of gravity of said reaction forces and that already for this reason the device operates more quietly than heretofore known devices of the type involved. In addition thereto, also the double beat which is obtained by the employment according to the invention of two tamping feet at the ends of a rocker, a decrease in the reaction forces upon the upper mass is effected which greatly aids the more quiet operation of the device. The inertia of the masses acts primarily counter to a rotary acceleration or spin, and only the transverse force is vertically separated from the moment. A further advantage results from the employment of an axle energy storage element for both tamping feet operating at double beat whereby a particularly high degree of efficiency is realized. The device can also be easily moved by means of a U-shaped handle arranged thereon and in view of the weight of the upper mass which is balanced with regard to the frame axle. In addition thereto, for the movement of the device according to the invention by changing the preload of the energy storage element, (lifting or pressing of the U-shaped handle) force componants can be mobilized in forward or returned direction. There also exists the possibility of realizing a simple automatic drive by the installation of a clutch effective in one direction of rotation only, for instance a ratchet wheel, with preferably reversible direction of action between the rocker and the wheels and by means of which thus depending on the selected direction of action, an automatic forward or rearward drive can be realized. Advantageous further developments of the invention also consist in that the masses of the tamping device which are provided on both sides of the frame and the spacing between the center of gravity of said masses from said frame axis are equal. In this way, the quiet operation of the device will additionally be aided.

Furthermore, that angle between the two arms of the rocker which face toward the ground is less than 180°. As a result thereof, it is possible to operate with relatively large wheels while the oscillating stroke of the rocker is still small. The energy storing device consists of a leaf spring which extends approximately perpendicularly with regard to the forward movement. Said leaf spring is at its central area connected to the connecting rod of the driving connection and at the ends is connected to one each of two legs parallel to each other of one rocker arm. This construction excels in particular by simplicity and ruggedness.

Referring now to the drawing in detail, the device shown therein comprises an upper mass 1 which substantially comprises the motor 1*a* and the crankdrive 1*b*, and is supported by the supporting frame 2. The device furthermore comprises a frame axle 3 and wheels 4, the axis of rotation of which coincides with the axis of the frame axle. The device according to the invention also comprises a rocker 5 with the two arms 5*a* and 5*a'* which are pivotable about the frame axle 3 in a plane which is about parallel to the direction of movement and about perpendicular to the ground (in FIG. 1 the drawing plane). The legs 5*a*, 5*a'* respectively comprise two arms 5*b*, 5*c* which are substantially parallel to each other. The device is equipped with tamping feet 6 respectively arranged at one and the other end of the rocker 5. There is furthermore provided a driving connection 7 between the eccentric drive 1*b* and the rocker 5. The connecting rod of the driving connection is designated with the reference numeral 8. An energy storing element, in the specific case a leaf spring, is provided in the driving connection 7 while said leaf spring is at its central area connected to the connecting rod 8 and has its ends respectively connected to arms 5*b* and 5*c* of one rocker arm 5*a*. A U-shaped handle 10 is connected to the supporting frame 2. The axis of gravity of the upper mass is designated with the reference numeral 11. The arrow 12 in FIG. 1 indicates the direction of the forward and rearward movement.

As will be seen from FIG. 2, of the two parallel arms 5*b* and 5*c* of the two rocker legs 5*a* and 5*a'*, one arm is located on one side and the other arm is located on the other side of the supporting frame 2. These arms 5*b* and 5*c* are rigidly interconnected at their ends by the tamping feet 6.

Between the rocker arm 5 and the wheels 4 there may be interposed a clutch which is effective only in one direction of rotation and which brings about that the wheels turn slightly when the rocker carries out half an oscillation in the effective direction of the clutch. During the other half oscillation of the rocker, the clutch is ineffective so that the device is by the rocker 5 moved forward only in one direction. The direction of action or the effective direction of the clutch indicated in the drawing by the arrows 13 only is preferably reversible. In this instance, the device can selectively be operated in an automatic forward direction and also in an automatic rearward direction.

It is, of course, to be understood, that the present invention is, by no means, limited to the specific showing in the drawing, but also comprises any modifications within the scope of the appended claims.

What is claimed is:

1. A tamping device comprising; a frame including spaced ground engaging support elements and a horizontal shaft extending laterally therebetween, an engine and an output member supported by said engine and driven thereby, said output member having an eccentric thereon, said engine being tiltably supported on said shaft, a fore and aft rocker having a central portion tiltably engaging said shaft and having a tamping foot at each end, said tamping feet being engageable with the ground alternately as the rocker tilts on said shaft, and a drive member having one end connected to the eccentric on said output member and the other end operatively connected to said rocker at a point therealong spaced from said shaft.

2. A tamping device according to claim 1 in which said tamping feet have equal masses while the centers of gravity thereof are spaced equally from said shaft on respective sides thereof.

3. A tamping device according to claim 1 in which said rocker comprises arm means each having a tamping foot at the outer end while being integral at the other end, said arm means making an included angle of less than 180° therebetween on the downwardly facing side of the rocker.

4. A tamping device according to claim 1 in which said rocker comprises a pair of laterally spaced fore and aft arm elements pivotally connected at an intermediate point to said horizontal shaft and having one of said tamper feet at each end, said eccentric being disposed in the lateral range between said arm elements and spaced in the fore and aft direction from said horizontal shaft, a leaf spring beneath said eccentric extending laterally between and at the ends connected to said arm elements, said drive member having the upper end connected to said eccentric and the lower end connected to an intermediate point along the leaf spring.

5. A tamping device according to claim 1 in which said support elements are wheels supporting the device for movement in the fore and aft direction, and a unidirectional drive clutch means between said rocker and at least one of said wheels for automatic movement of the device as the rocker rocks.

6. A tamping device according to claim 5 in which said clutch means is reversible.

7. A tamping device according to claim 1 in which said engine and output member are disposed above said shaft and are substantially balanced thereon, said rocker being disposed beneath said shaft, said engine and output member forming a reaction mass for the rocker when the device is in operation.

* * * * *